United States Patent [19]

Asada et al.

[11] 4,262,037

[45] Apr. 14, 1981

[54] METHOD OF PRODUCING FERROMAGNETIC METAL POWDER

[75] Inventors: Seiichi Asada, Hachioji; Masahiro Amemiya, Takatsuki, both of Japan

[73] Assignee: Hitachi, Ltd., Tokyo, Japan

[21] Appl. No.: 783,648

[22] Filed: Apr. 1, 1977

[30] Foreign Application Priority Data

Apr. 5, 1976 [JP] Japan ..... 51/37200

[51] Int. Cl.[3] ..... B05D 5/12

[52] U.S. Cl. ..... 427/127; 427/130; 427/132; 427/217; 427/229

[58] Field of Search ..... 427/229, 216, 217, 132, 427/128, 130, 127

[56] References Cited

U.S. PATENT DOCUMENTS

| | | | |
|---|---|---|---|
| 2,639,999 | 5/1953 | McLean | 427/229 |
| 2,658,837 | 11/1953 | Blackman | 427/229 |
| 2,763,576 | 9/1956 | Belitz et al. | 427/229 |
| 2,979,424 | 4/1961 | Whitehurst et al. | 427/229 |
| 3,042,543 | 7/1962 | Schuele | 427/128 |
| 3,202,537 | 8/1965 | Norman et al. | 427/217 |
| 3,342,587 | 9/1967 | Goodrich et al. | 427/217 |
| 3,416,932 | 12/1968 | Mathias et al. | 427/128 |
| 3,501,333 | 3/1970 | Groves et al. | 427/229 |
| 3,535,103 | 10/1970 | Whitfield | 427/229 |
| 3,542,589 | 11/1970 | Hartman et al. | 427/128 |
| 3,549,412 | 12/1970 | Frey | 427/217 |
| 3,563,787 | 2/1971 | Schneggenburger et al. | 427/229 |
| 3,574,683 | 4/1971 | Johston | 427/128 |
| 3,574,685 | 4/1971 | Haines | 427/229 |
| 3,856,580 | 12/1974 | Smeggil et al. | 427/217 |
| 3,856,581 | 12/1974 | Smeggil et al. | 427/217 |
| 3,856,582 | 12/1974 | Smeggil et al. | 427/217 |

*Primary Examiner*—Ronald H. Smith
*Assistant Examiner*—Janyce A. Bell
*Attorney, Agent, or Firm*—Craig and Antonelli

[57] ABSTRACT

A method of producing ferromagnetic metal powder comprises the steps of dipping an iron compound powder in a solution in which an aluminum compound and/or a titanium compound is dissolved, removing solvent from the iron compound powder, reducing the iron compound powder in a reducing atmosphere at an elevated temperature and forming oxide layers on whole surfaces of the individual particles of the iron powder. Ferromagnetic iron powder produced according to this method has both a high coercive force and a high remanence ratio.

24 Claims, 4 Drawing Figures

Hc (Oe)
σm(emu/g)
σr/σm
1000
800
600
400
200
0
100
80
60
40
20
0
0.6
0.5
0.4
0.3
0.2
0.1
0
3
2
1
0
0.2
0.4
20
40
60
80
100
ALCH-TR CONTENT IN SOLUTION (g/l)

Hc (Oe)
σm(emu/g)
σr/σm
1000
800
600
400
200
0
100
80
60
40
20
0
0.6
0.5
0.4
0.3
0.2
0.1
0
6
5
4
0
0.2
0.4
10
20
30
AgNO3 CONTENT IN SOLUTION (g/l)

Hc (Oe)
σm (emu/g)
σr/σm
1000
800
600
400
200
0
100
80
60
40
20
0
0.6
0.5
0.4
0.3
0.2
0.1
0
0
0.2
0.4
20
40
60
80
100
TBT CONTENT IN SOLUTION (g/l)
6
7
8

METHOD OF PRODUCING FERROMAGNETIC METAL POWDER

BACKGROUND OF THE INVENTION

1. Field of the Invention

The present invention relates to a method of producing ferro-magnetic metal powder composed of iron or iron base alloy, and more particularly to a method of producing ferromagnetic metal powder usable as a high density magnetic recording medium for a magnetic tape, a magnetic drum, a magnetic disc or the like.

2. Brief Description of the Prior Art

Many methods of producing ferromagnetic metal power have been investigated heretofore. These methods can be roughly classified as follows:

(i) method comprising the steps of dissolving a compound of ferromagnetic metal in water and adding thereto reducing agent containing boron hydride irons or hypophosphite ions.

(ii) method comprising the step of reducing an oxalate, a formate, an oxide or an oxyhydroxide of ferromagnetic metal in a reducing atmosphere at an elevated temperature, (iii) method comprising the steps of preparing an aqueous solution in which a compound of ferromagnetic metal is dissolved and electrolyzing the solution, and so on.

The metal powder for a high density magnetic recording medium is desired to be composed of particles of high coercive force and high remanence ratio having needlelike shape and uniform size. However, it is difficult to obtain such needlelike shaped and uniform-sized metal powder by the above-mentioned prior art methods. Namely, according to the above-mentioned prior art method (i), we can obtain a powder composed of only sphere-shaped particles, dielike-shaped particles or chain-sphere-shaped particles which are formed by linking the globe-like or dielike-shaped particles together. According to the above-mentioned prior art method (iii), the shape of the obtained particles of the powder is only dendritic. Furthermore, in the above-mentioned prior art (ii), although somewhat needlelike shaped particle powder can be obtained when needlelike shaped oxalate, formate, oxide or oxyhydroxide is used as a starting material, it is difficult to obtain uniform-sized metal powder particles having needlelike shape because the particles link together or break in the reducing process at an elevated temperature. As mentioned above, it is very difficult to obtain needlelike shaped ferromagnetic metal powder according to the prior art.

SUMMARY OF THE INVENTION

It is an object of the present invention to provide an improved method to produce ferromagnetic iron or iron base powder. It is another object of the present invention to provide a method of producing needlelike-shaped and uniform sized ferromagnetic iron or iron base powder having both a high coercive force and a high remanence ratio.

On our various investigations concerning the method of producing needlelike ferromagnetic metal powder it was found that the needle-like ferromagnetic metal powder could be obtained according to the method in which the above-mentioned prior art method (ii) was improved. The present invention, which is based on our above-mentioned discovery, provides a method for producing needlelike-shaped ferromagnetic metal powder having a high coercive force and a high remanence ratio, by improving the above-mentioned prior art method (ii) which comprises the step of reducing a metal compound such as an oxalate, a formate, an oxide or an oxyhydroxide of ferromagnetic metal at an elevated temperature.

In the method of the present invention, there also is used as a starting raw material, oxalate, formate, oxide or oxyhydroxide of iron or iron base alloy, or their mixture, among which the oxide and the oxyhydroxide are preferable because of the facility of obtaining needlelike shaped powder. It is to be desired that the particles of the raw material are needlelike and they have axial ratios (namely, the ratios of the major axis length to the minor axis length) of greater than about 5 and major axis lengths of from about 0.1 μm to about 1 μm. In general, the axial ratio of the raw material particles, which can be obtained with facility, may be less than 20. Furthermore, another reason why the oxide and the oxyhydroxide are preferable is that the number of atoms made free at the heating and reducing step is few whereby the particles are hard to break down. In addition, the iron compound containing less than 10 mol % of Co, Ni, Cr, Al, Cu or the like, based on the amount of Fe, may be used as the starting material.

In this invention, the above-mentioned starting material powder composed mainly of iron compound is reduced by heating it in a reducing atmosphere after the starting material powder is coated with a solution of at least one compound selected from the group consisting of aluminum compound and titanium compound, and then the solvent of the solution is removed by drying. The drying step may be omitted when the solvent can be removed by natural drying, in another step. As the aluminum compound or titanium compound, there can be used an organometallic compound of aluminum or titanium, or an inorganic aluminum or titanium compound such as nitrate, sulfate, chloride or the like, the solubility of which in a solvent such as water, aqueous alkaline solution, aqueous acidic solution or organic solvent is greater than 0.05 g/l, and preferably than 0.1 g/l. For example, alkyl, alkoxy, alkyl halide, alkoxy halide, aromatic, aromatic halide or chelate compounds of aluminum or titanium, or the like such as listed in Tables 1 and 3 can be shown as the above-mentioned organometallic compound. In any case, there may be used any aluminum or titanium compound soluble in a proper solvent.

Furthermore, a more desirable result can be obtained when a solution containing silver ions ($Ag^+$) is used with the above-mentioned solution containing aluminum compound and/or titanium compound. Both of them may be used as a mixed solution or as separate two solutions. The starting material powder is dipped for coating once in the former case, but twice in the latter case, namely, it should be dipped in an aluminum and/or titanium compound solution and in a silver ions solution separately. The dipping sequence may be arbitrary. In the former case, the solutions comprised by the mixed solution should not react with each other. As the silver compound used for the solute of the silver ions containing solution, there can be used many inorganic silver salts such as silver nitrate, silver sulfate and silver chloride.

For the solvent of the aluminum and/or titanium compound, there can be used any solvent, in which greater than 0.05 g/l, and preferably than 0.1 g/l of the solute can be dissolved, such as water, aqueous alkaline solution, aqueous acidic solution and may organic solvents. These solvents may be mixed as one solvent, when they does not react with each other. Usually, water, ammonia water, sulfuric acid, nitric acid and hydrochloric acid may be used as the inorganic solvent. In an inorganic solvent, the hydrogen exponent (pH) thereof may range from 0 to 14. As the organic solvent, benzene, derivatives of benzene, aliphatic hydrocarbons and alicyclic hydrocarbons having melting points lower than room temperature and boiling points higher than room temperature can be used.

In the solution containing silver ions, water, aqueous alkaline solutions such as ammonia water, aqueous acidic solutions such as nitric acid, and alcohol, and mixtures thereof are employed as solvent. Alcohol can be used only for silver nitrate. An aqueous ammonium alkaline solutions is preferable, among the aqueous alkaline solutions. In an inorganic solvent, the hydrogen exponent thereof may range from 0 to 14.

In the method of the present invention, the amount of the aluminum and/or titanium compound in the above-mentioned solution ranges from 0.05 g/l to 100 g/l. When the amount of the aluminum and/or titanium compound in the solution is less than 0.05 g/l, it is difficult to expect a much better result than the prior art method. When it is greater than 100 g/l, the saturation magnetization of the produced powder shows a tendency to decrease. The preferable amount thereof ranges from 0.1 g/l to 25 g/l.

Furthermore, the silver compound may be contained in the solution in the amount of from 0.05 g/l to 30 g/l and preferably from 0.1 g/l to 25 g/l. The reason of the limitation of the silver compound content in the solution is almost the same as the above-mentioned aluminum and/or titanium compound solution, except that the silver compound may not be dissolved completely when the amount thereof is too large.

The temperatures of the solution of the aluminum and/or titanium compound and the silver compound solution may be a room temperature, approximately. In addition, the dipping of the starting material powder into the solution of aluminum and/or titanium compound should be kept until the particles of the powder are coated therewith. Various dipping time is necessary for the coating process, according to the powder condition such as the lump size, the density, or the like. Respecting the time necessary for dipping into the silver compound solution, the same description as mentioned above can be stated.

For example, FIG. 1 shows the relation between the concentration of aluminum-tris-ethyl-acetoacetate (hereinafter abbreviated as ALCH-TR), which is one of organometallic compounds of aluminum, in the solution and the magnetic properties of the obtained ferro-magnetic iron powder in the method of the present invention. As apparent from the figure, the ferromagnetic metal powder produced according to the method of this invention is greatly improved in the coercive force (curve 1) and the remanence ratio (curve 3), as compared with the case in which no aluminum compound is used as in the prior art method. In addition, it is obvious that a large desirable effect can be obtained using even very dilute solution of the aluminum compound such as ALCH-TR.

Almost the same result as above can be obtained in the case of titanium compound such as tetrabutyl titanium (hereinafter abbreviated as TBT), as apparent from FIG. 3.

Additionally, a more desirable result can be obtained when a silver compound solution is employed with a aluminum and/or titanium compound solution as apparent from FIG. 2, which shows the relation between the silver nitrate concentration in the solution and the magnetic properties of the obtained ferromagnetic iron powder in the case of using ALCH-TR solution of 2.5 g/l concentration. In FIGS. 2 and 3, numerals 4 and 7 designate the coercive foce, and 6 and 9 and remanence ratio.

The detailed description of FIGS. 1, 2 and 3 will be set forth below in the description concerning examples 1, 2 and 3.

Any reducing atmosphere containing reducing gas such as $H_2$, CO and their mixture may be used at the heating step for reduction. Furthermore, $H_2$ gas and town gas can be obtained easily and are, therefore, preferable.

The suitable reducing temperature ranges from 220° C. to 450° C., and preferably from 220° C. to 350° C. When the heating temperature is lower than the above-mentioned lower limit of the suitable temperature range, the reducing phenomenon occurs insufficiently. On the other hand, the reduced particles stick together or sinter, when the heating temperature is too high. Of course, both cases are not suitable because of the deterioration of the magnetic properties.

Depending on the composition of the reducing atmosphere and the heating temperature, various heating time is necessary for reduction process. The discharged gas of the heating atmosphere contains small amount of oxydizing gas produced by the reduction process, such as $H_2O$ and $CO_2$. The amount of oxydizing gas in the discharged gas decreases as the reducing process advances, we can, accordingly, practically recognize the completion of the reduction process by detecting the amount of $H_2O$ and/or $CO_2$ in the discharged gas, and the necessary heating time becomes apparent naturally. Preferable result can be obtained when the reducing process is carried on until the partial pressure of $H_2O$ and/or $CO_2$ in the discharge gas lowers to $4.9\times10^{-2}$ mmHg.

The produced powder can become corrosion-resistant and convenient to handle, by forming surface layers such as oxide layers on the surface of the produced metal particles according to any method concerning the nonactivation treatment of active pure iron powder, namely by making the particle surfaces nonactive. For example, the powder is dipped in an organic solvent and then air is blown into the solvent containing the powder, simultaneously the solvent is stirred, so as to form surface layers. Usually, the sufficient time of this treatment is more than 1 hour, but it should be changed according to the amount of the powder. Of course, any other well-known method of nonactivation treatment of pure iron will do for this purpose.

The ferromagnetic iron or iron base alloy powder produced according to the aforementioned method has both a high coercive force and a high remanence ratio as compared with that produced by a conventional method.

Other and further objects, features and advantages of the invention will be apparent more fully from the following description taken in connection with the accompanying drawings.

DESCRIPTION OF THE PRESENTLY PREFERRED EMBODIMENTS

Example 1

One hundred grams of needlelike α-FeOOH having axial ratios of 10±2 and major axis lengths of 0.4±0.1 μm were dipped in 400 ml of solution of ALCH-TR, the contents of which were various and which was dissolved in toluene, then the solution was stirred for one hour, and subsequently the solids were sucked and dried in vacuum. Two grams of the α-FeOOH obtained thus were reduced by heating in an atmosphere of hydrogen at 370° C. for ten hours. After that, the reduced material was cooled slowly to about 100° C., then the atmosphere was changed from hydrogen to nitrogen at 100° C. After this change of the atmosphere, it was cooled to room temperature taking one day and one night, simultaneously gradually introducing air into the sample vessel through a hole of 2 mm diameter. Then, there was obtained metal powder composed of fine needlelike particles, the surfaces of which were covered with iron oxide and which had an axial ratio of about 8, and a major axis length of about 0.4 μm. Thus, the shape and size of the obtained iron powder particles were almost the same as those of the α-FeOOH used as the starting raw material.

Figure 1:
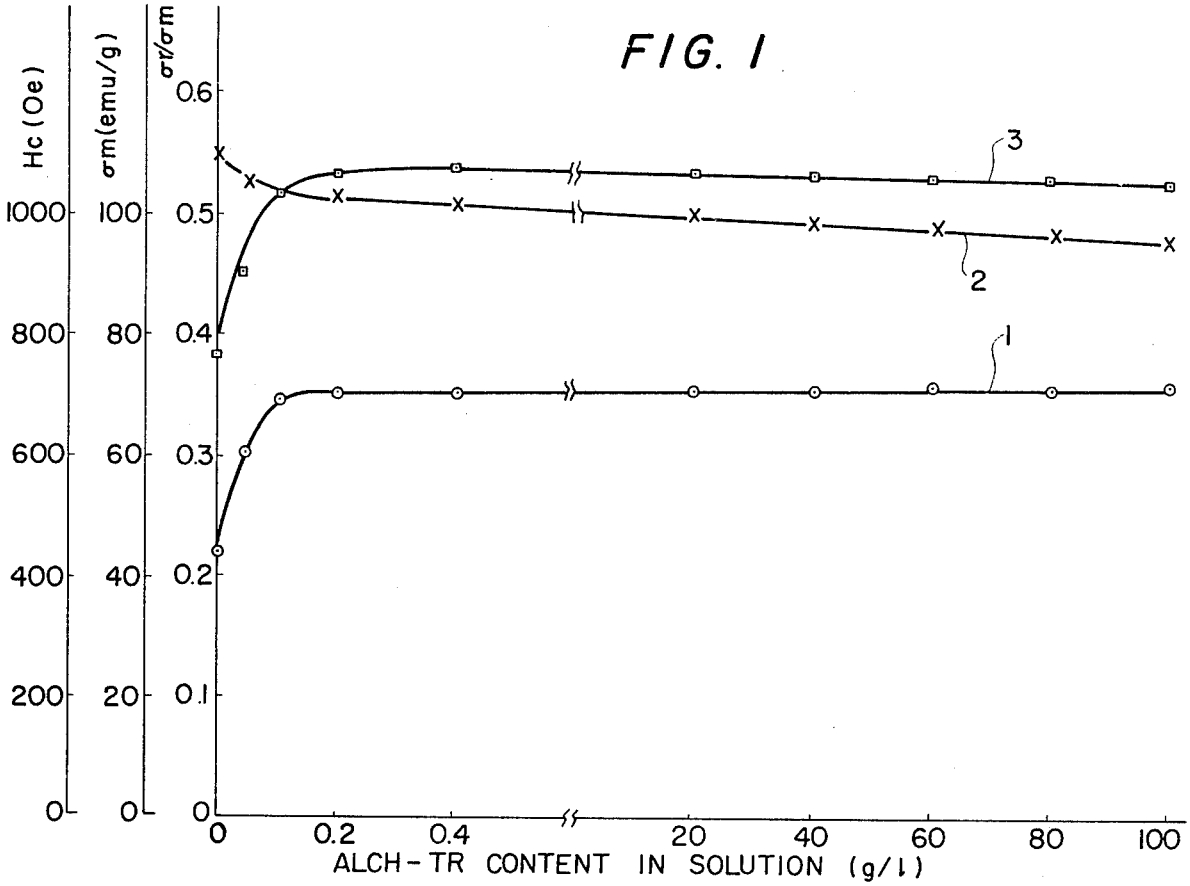
FIG. 1 is a diagram illustrating the relation between the ALCH-TR concentration in the solution and the magnetic properties of the obtained iron powder in an embodiment of the present invention.

FIG. 1 illustrates the relation between the ALCH-TR content in the used solution and the magnetic properties of the iron powder obtained as mentioned above. In the figure, curves 1, 2 and 3 represent the coercive force Hc, the saturation magnetization $\sigma_m$ and the remanence ratio $\sigma_r/\sigma_m$, respectively.

The magnetic properties of the samples were measured in the magnetic field of 2000 Oe at maximum with the use of a B-H tracer.

As apparent from FIG. 1, we could obtain ferromagnetic iron powder being excellent in the coercive force and the remanence ratio, by the above-mentioned method comprising the steps of coating α-FeOOH with the ALCH-TR solution and reducing it at an elevated temperature. A remarkable effect may be expected even when the ALCH-TR content in the solution is so low as 0.05~0.1 g/l.

Example 2

The procedures of Example 1 were repeated in the same manner except that the aluminum compounds shown in Table 1 were used and the aluminum compound content in the solution was 2.5 g/l, to thereby produce iron powder, the magnetic properties of which are shown in Table 1.

As seen from Table 1, every aluminum compound solution had an enough effect. In addition, the obtained iron powder particles had axial ratios of about 8 and major axis lengths of about 0.4 μm to thereby be very needlelike fine particles.

TABLE 1

| Sample No. | Aluminum Compound | Hc (Oe) | $\sigma_m$ (emu/g) | $\sigma_r/\sigma_m$ |
|---|---|---|---|---|
| 1 | $CH_3AlCl_2$ | 730 | 102 | 0.54 |
| 2 | $(CH_3)_3Al$ | 700 | 103 | 0.53 |
| 3 | $(C_2H_5)_3Al$ | 720 | 103 | 0.54 |
| 4 | $(C_6H_5)_3Al$ | 690 | 104 | 0.53 |
| 5 | $Al(C_2H_5)_3 . (C_2H_5)_2O$ | 720 | 103 | 0.54 |
| 6 | $(P—CH_3C_6H_4)_3Al$ | 710 | 104 | 0.53 |
| 7 | $(CH_3)_2AlOCH_3$ | 710 | 102 | 0.53 |

Example 3

The procedures of Example 1 were repeated in the same manner except that the iron oxyhydroxide or iron oxide shown in Table 2 was used as a starting raw material and the content of ALCH-TR in the solution was 2.5 g/l, to thereby produce iron powder, the magnetic properties of which are shown in Table 2. The shape and the size of the starting material particle is the same as Example 1. The α-$Fe_2O_3$ shown in Table 2 is produced by heating the α-FeOOH at 570° C. in air for 2 hours.

TABLE 2

| Sample No. | Starting Raw Material | Hc (Oe) | $\sigma_m$ (emu/g) | $\sigma_r/\sigma m$ |
|---|---|---|---|---|
| 11 | β-FeOOH | 680 | 106 | 0.52 |
| 12 | γ-FeOOH | 710 | 103 | 0.53 |
| 13 | γ-$Fe_2O_3$ | 750 | 101 | 0.54 |
| 14 | α-$Fe_2O_3$ | 740 | 102 | 0.54 |
| 15 | $Fe_3O_4$ | 730 | 100 | 0.54 |

As seen from Table 2, in the case of using any iron hydroxide or any iron oxide, the iron powder of good magnetic properties could be obtained. In addition, the obtained iron powder particles had axial ratios of 5~8 and major axis lengths of about 0.4 μm to thereby be very needlelike fine particles.

Example 4

The procedures of Example 1 were repeated in the same manner with the exception that the γ-$Fe_2O_3$, whose particle surfaces were covered with nickel by an electroless plating, was used as the starting raw materials and the content of ALCH-TR in the solution was 2.5 g/l, to thereby produce iron powder, whose molar ratio of Fe to Ni was 90:10 and whose magnetic properties were as follows: The coercive force Hc, the saturation magnetization $\sigma_m$ and the remanence ratio $\sigma_r/\sigma_m$ were 690 Oe, 95 emu/g and 0.49, respectively. Furthermore, respecting the particle shape and particle size thereof, the axial ratio and the major axis length were 5 and 0.4 μm, respectively.

As seen from the above-mentioned description on this example, we can obtain a Ni containing iron powder excelling in Hc and $\sigma_r/\sigma_m$, by the method of present invention.

Example 5

The procedures of Example 3 were repeated in the same manner with the exception that the α-FeOOH containing 5 mol.% of Co based on the amount of Fe was used as the starting raw material and town gas was used as the reducing gas, to thereby produce iron powder.

The magnetic and dimensional properties of the obtained iron powder particle were as follows: The coercive force Hc, the saturation magnetization $\sigma_m$ and the remanence ratio $\sigma_r/\sigma_m$ were 730 Oe, 101 emu/g and 0.54, respectively. The axial ratio and the major axis length were 7 and 0.4 μm, respectively.

From the above description concerning this example, it becomes apparent that Co containing iron powder having high Hc and high $\sigma_r/\sigma_m$ can be obtained by the method of the present invention.

Example 6

The procedures of Example 3 were repeated in the same manner with the exception that the α-FeOOH containing 5 mol.% of Cr, 5 mol.% of Al and 1 mol.% of Cu based on the amount of Fe was used as the starting raw material, to thereby produce iron powder.

The magnetic and dimensional properties of the obtained iron powder particle were as follows: The coercive force Hc, the saturation magnetization $\sigma_m$ and the remanence ratio $\sigma_r/\sigma_m$ were 670 Oe, 93 emu/g and 0.51, respectively. The axial ratio and the major axis length were 7 and 0.4 μm, respectively.

From the above-mentioned description of this example, it becomes apparent that Cr, Al and Cu containing iron powder having high Hc and High $\sigma_r/\sigma_m$ can be obtained by the method of the present invention.

Example 7

The procedures of Example 1 were repeated in the same manner with the exception that the α-FeOOH powder, which was dipped in 400 ml of solution of ALCH-TR dissolved in toluene (the content of ALCH-TR was 2.5 g/l), was dipped again in 400 ml of solution of various content of $AgNO_3$ dissolved in ethanol, then the solution was stirred for one hour. Thus, there was produced iron powder, the magnetic properties of which were shown in FIG. 2.

Figure 2:
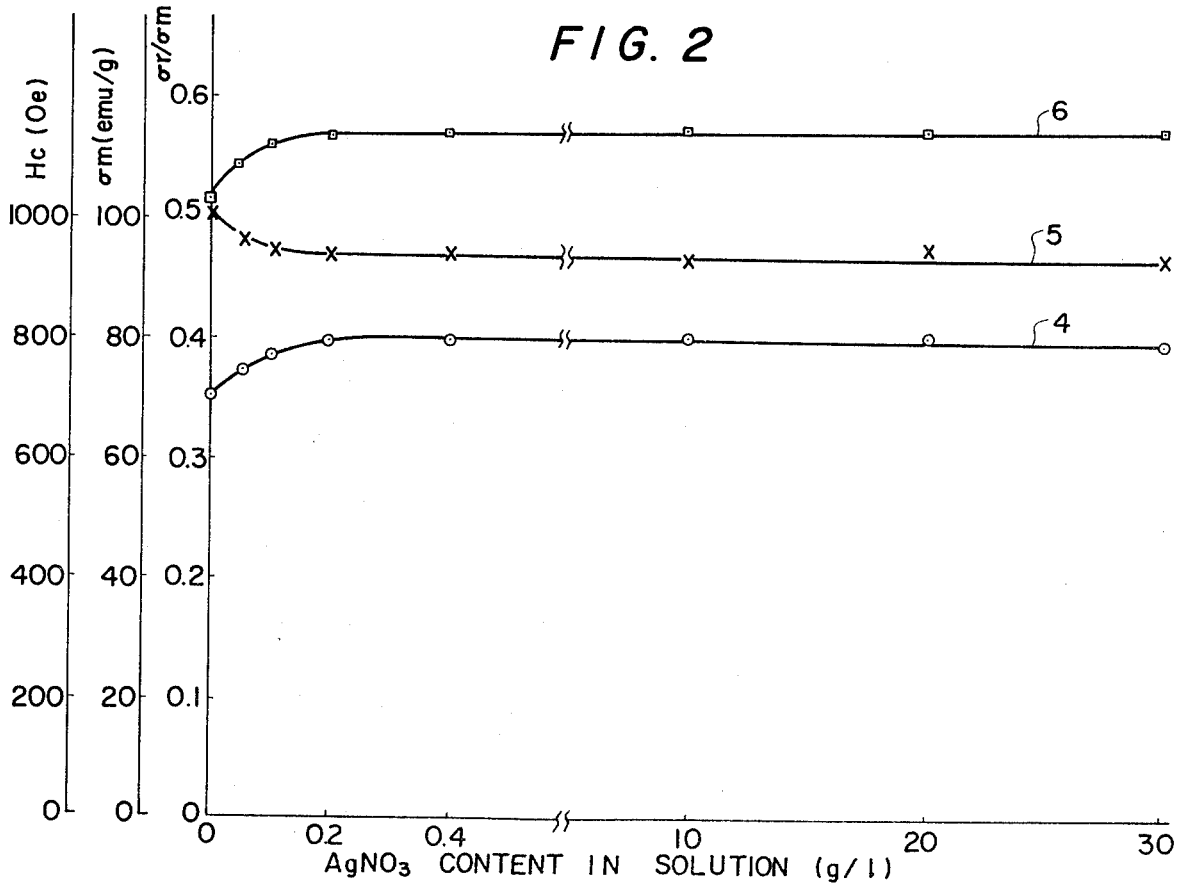
FIG. 2 is a diagram illustrating the relation between the silver compound concentration in the solution and the magnetic properties of the obtained iron powder in the case of using both ALCH-TR and $AgNO_3$, in another embodiment of the present invention.

FIG. 2 illustrates the relation between the $AgNO_3$ content in the used solution and the magnetic properties of the obtained iron powder. In the figure, curves 4, 5 and 6 represent the coercive force Hc, the saturation magnetization $\sigma_m$ and the remanence ratio $\sigma_r/\sigma_m$, respectively. The magnetic properties of the samples were measured in the same method as Example 1.

As apparent from FIG. 2, we could obtain ferromagnetic iron powder being very excellent in the coercive force and the remanence ratio, by the above-mentioned method comprising the steps of dipping the iron compound powder in an ALCH-TR solution followed by dipping it at an elevated temperature. The magnetic properties thereof were better than those obtained by using only ALCH-TR solution. An enough effect may be expected even when the $AgNO_3$ content in the solution is so low as 0.05 g/l. Further, the iron powder particles, obtained by coating with both the ALCH-TR solution and the $AgNO_3$ solution having the content of greater than 0.1 g/l, had axial ratios of 9 and major axis lengths of 0.4 μm to thereby be very needlelike fine particles.

Example 8

Figure 4:
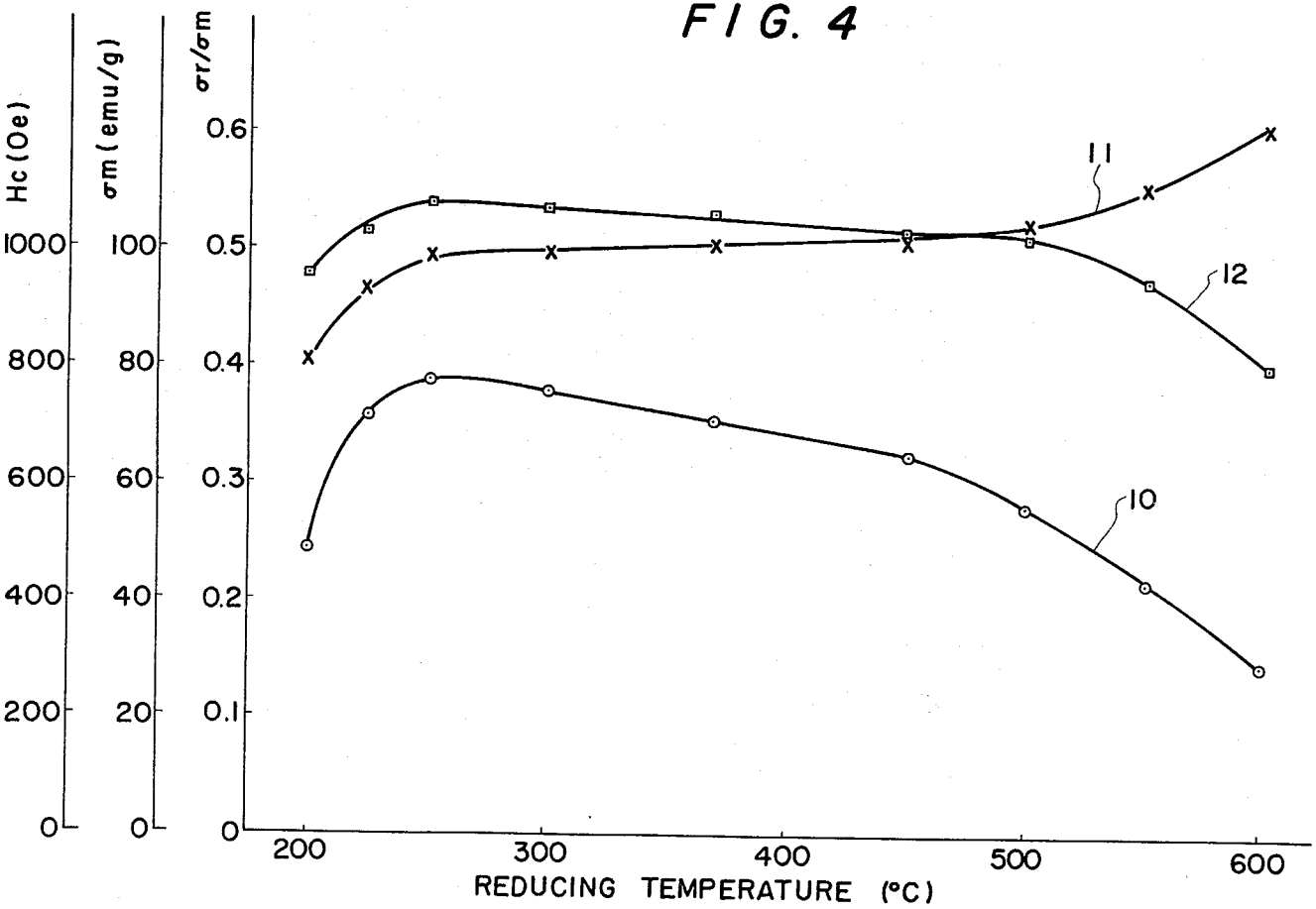
FIG. 4 is a diagram illustrating the relation between the reducing temperature and the magnetic properties of the obtained iron powder in the case of using both a solution of ALCH-TR and a solution of $AgNO_3$, in a further embodiment of the present invention.

The procedures of Example 7 were repeated in the same manner except that the content of $AgNO_3$ in the solution was 2.5 g/l, and the reduction procedure was conducted at various heating temperatures to thereby obtain iron powder. The relation between the reducing temperature and the magnetic properties of the obtained iron powder is illustrated by FIG. 4. In the figure, curves 10, 11 and 12 represent the coercive force Hc, the saturation magnetization $\sigma_m$ and the remanence ratio $\sigma_r/\sigma_m$, respectively.

As apparent from FIG. 4, there could be obtained the ferromagnetic iron powder of high coercive force and high remanence ratio by the aforementioned method in which the reducing temperature was between 220° C. and 450° C., and preferably between 220° C. and 350° C. Furthermore, the iron powder particles, obtained by reducing at the temperature from 220° C. to 450° C., had axial ratios of 8 and major axis lengths of 0.4 μm, and they were very needlelike fine particles.

Example 9

Figure 3:
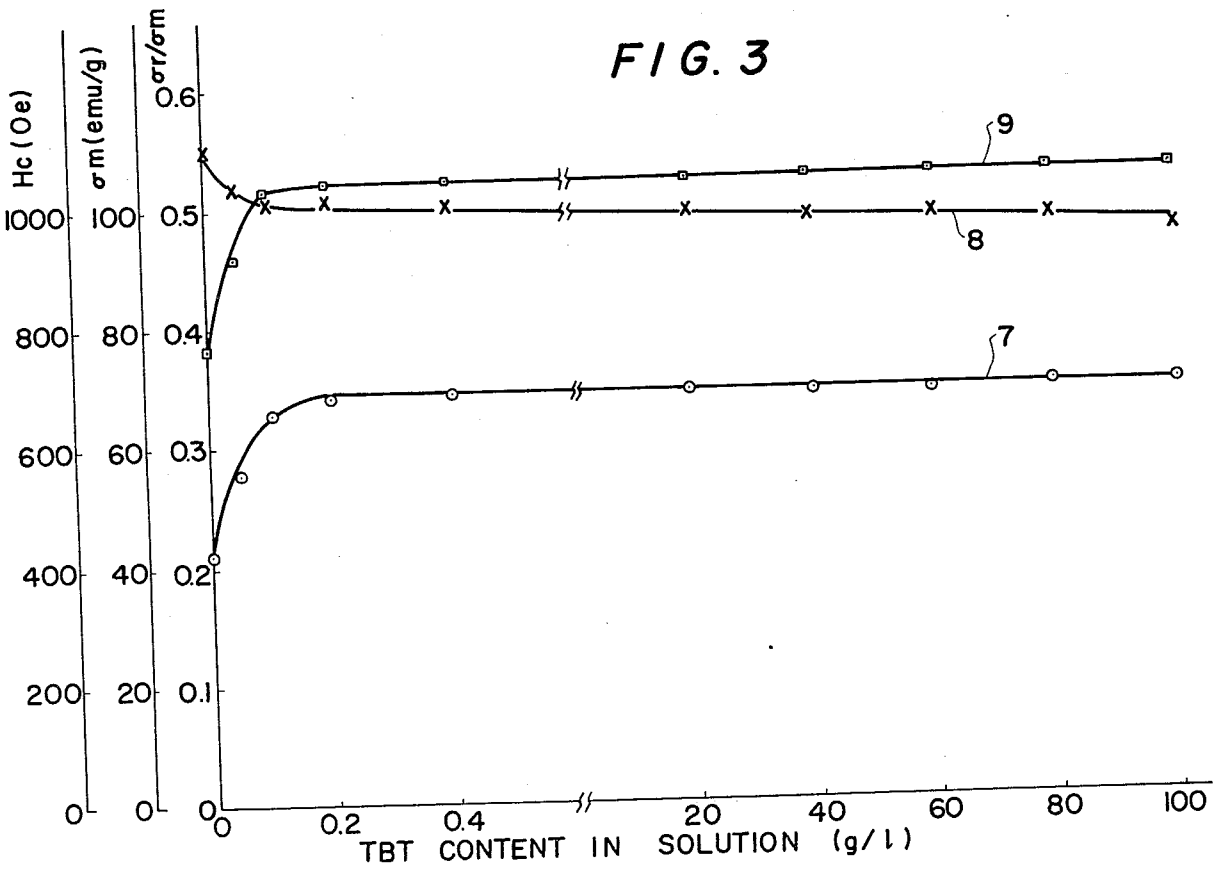
FIG. 3 is a diagram illustrating the relation between the TBT concentration in the solution and the magnetic properties of the obtained iron powder in still another embodiment of the present invention.

The procedures of Example 1 were repeated in the same manner except that TBT was employed instead of ALCH-TR to thereby obtain iron powder. FIG. 3 illustrates the relation between the TBT content in the used solution and the magnetic properties of the iron powder obtained as mentioned above. In the figure, curves 7, 8 and 9 represent the coercive force Hc, the saturation magnetization $\sigma_m$ and the remanence ratio $\sigma_r/\sigma_m$, respectively.

As apparent from FIG. 3, we could obtain iron powder being excellent in the coercive force and the remanence ratio, by the above-mentioned method comprising the steps of coating α-FeOOH with the TBT solution and reducing it at an elevated temperature. A remarkable effect may be expected even when the TBT content in the solution is so low as 0.05~0.1 g/l.

In addition, the axial ratio and the major axis length of the iron powder particle, which was obtained by the above-mentioned method comprising the step of treating the raw material powder with the solution containing more than 0.05 g/l of TBT, were 8 and 0.4 μm, respectively. Thus, the shape and size of the obtained iron powder particles were almost the same as those of the α-FeOOH used as the starting raw material.

EXAMPLE 10

The same procedures as Example 1 were carried out with the exception that the titanium compounds shown in Table 3 were used instead of ALCH-TR and that the content of the titanium compound in the solution was 2.5 g/l, to thereby produce iron powder, whose magnetic properties were shown in Table 3.

As is seen from Table 3, every titanium compound solution had an enough effect. In addition, the obtained iron powder particles had axial ratios of 8 and major axis lengths of 0.4 μm to thereby be very needlelike fine particles.

TABLE 3

| Sample No. | Titanium Compound | Hc (Oe) | $\sigma_m$ (emu/g) | $\sigma_r/\sigma_m$ |
|---|---|---|---|---|
| 21 | $(\pi\text{-}C_5H_5)_2Ti$ | 730 | 99 | 0.54 |
| 22 | $(CH_3)Cl_3Ti$ | 710 | 100 | 0.53 |
| 23 | $(\pi\text{-}C_5H_5)_2(C_6H_5)_2Ti$ | 730 | 102 | 0.54 |
| 24 | $(i\text{-}C_3H_70)_3(C_6H_5)Ti$ | 690 | 104 | 0.53 |

TABLE 3-continued

| Sample No. | Titanium Compound | Hc (Oe) | $\sigma_m$ (emu/g) | $\sigma_r/\sigma_m$ |
|---|---|---|---|---|
| 25 | $(CH_3)_2Cl_2Ti$ | 700 | 101 | 0.53 |

Example 11

The procedures of Example 10 were repeated in the same manner except that aqueous solution containing 2.5 g/l of titanium nitrate was used as titanium compound solution to thereby obtain the iron powder whose manetic properties were almost the same as Example 10. Hc, $\sigma_m$ and $\sigma_r/\sigma_m$ thereof were 710 Oe, 102 emu/g and 0.53, respectively. The axial ratio and the major axis length of the obtained iron particle were 8 and 0.4 μm, respectively. The iron powder produced thus was also excellent in the magnetic properties as mentioned above.

Example 12

The procedures of Example 1 were repeated in the same manner except that the starting raw material powder was dipped in 400 ml of solution of ALCH-TR and TBT which were dissolved in toluene and the contents of which were both 1 g/l, to thereby produce iron powder, the magnetic properties of which were as follows: Hc, $\sigma_m$ and $\sigma_r/\sigma_m$ were 670 Oe, 99 emu/g and 0.53, respectively. Additionally, the axial ratio and the major axis length of the obtained iron powder particle were 8 and 0.4 μm, respectively.

As apparent from the above description of the example, there could be also obtained ferromagnetic iron powder being excellent in the coercive force Hc and the remanence ratio $\sigma_r/\sigma_m$ when the starting material was treated with a mixed solution of aluminum compound and titanium compound.

Example 13

The procedures of Example 12 were repeated in the same manner with the exception that the contents of ALCH-TR and TBT in the solution were both 0.05 g/l, to thereby obtain ferromagnetic iron powder being as high in Hc and $\sigma_r/\sigma_m$ as in the case of employing only the ALCH-TR solution of 0.1 g/l concentration or only the TBT solution of 0.1 g/l concentration. The coercive force Hc, the saturation magnetization $\sigma_m$ and the remanence ratio $\sigma_r/\sigma_m$ of the obtained iron powder were 680 Oe, 103 emu/g and 0.52, respectively. The shape and the size of the obtained iron particle were as follows: The axial ratio was 8 and the major axis length was 0.4 μm.

Example 14

The same procedures Example 1 were repeated with the exception that an aqueous solution of $Al(NO_3)_3 \cdot 9H_2O$, the content of which was 2.5 g/l, was used, to thereby produce iron powder, Hc, $\sigma_m$ and $\sigma_r/\sigma_m$ of which were 630 Oe, 102 emu/g and 0.52, respectively. The axial ratio and the major axis length of the obtained iron powder particle were 8 and 0.4 μm, respectively.

As is seen from the aforementioned example, ferromagnetic iron powder having high Hc and $\sigma_r/\sigma_m$ could be also obtained when the starting material was treated with an aqueous inorganic aluminum compound solution.

Example 15

The procedures of Example 14 were repeated in the same manner except that a solution of $AlCl_3$ and $TiCl_4$ dissolved in ethanol was employed instead of the aqueous $Al(NO_3)_3 \cdot 9H_2O$ solution, to thereby obtain almost the same results as Example 14.

Example 16

The procedures of Example 3 were repeated in the same manner except that needlelike iron oxalate particle powder, the axial ratio and the major axis length of which were 7±2 and 0.4±1, was used as the starting raw material, to thereby produce iron powder, the magnetic properties of which were as follows: The coercive force Hc, the saturation magnetization $\sigma_m$ and the remanence ratio $\sigma_r/\sigma_m$ were 500 Oe, 97 emu/g and 0.47, respectively. The axial ratio and the major axis length of the obtained iron particles were 4 and 0.3 μm, respectively.

On the other hand, when the above-mentioned starting raw material powder was not treated with the ALCH-TR solution, the magnetic properties of the obtained iron powder and the shape and the size of the obtained iron particles were shown as follows: Hc, $\sigma_m$ and $\sigma_r/\sigma_m$ were 230 Oe, 97 emu/g and 0.32, respectively. The axial ratio and the major axis length were about 2 and 0.3 μm, respectively.

As apparent from the results of this example mentioned above, when iron oxalate was used as the starting material, the magnetic properties such as Hc and $\sigma_r/\sigma_m$ of the obtained iron powder were much increased too by treating the starting material powder with the AlCH-TR solution.

What is claimed is:

1. A method of producing ferromagnetic iron powder comprising the steps of:

(i) coating a needlelike-shaped starting raw material powder with a solution containing from 0.05 g/l to 100 g/l of at least one compound selected from the group consisting of aluminum compound and titanium compound, said raw material being at least one selected from the group consisting of oxalate, formate, oxide and oxyhydroxide of iron, (ii) drying said powder coated at step (i), (iii) heating said powder at temperature ranging from 220° C. to 450° C. in a reducing atmosphere, and (iv) cooling said powder reduced in the preceding step (iii).

2. The method of claim 1, in which a solution containing silver ions is used with the solution of said aluminum and/or titanium compound at step (i).

3. The method of claim 1, in which said raw material is at least one selected from the group consisting of iron oxide and iron oxyhydroxide.

4. The method of claim 1, in which said raw material further comprises at least one selected from the group consisting of Co, Ni, Cr, Al and Cu, to the amount of less than 10 mol.% based on the amount of Fe.

5. The method of claim 2, in which said raw material further comprises at least one selected from the group consistig of Co, Ni, Cr, Al and Cu, to the amount of less than 10 mol.%, based on the amount of Fe.

6. The method of claim 1, in which said compound contained by said solution is at least one selected from the group consisting of organometallic compound of aluminum and inorganic compound of aluminum.

7. The method of claim 1, in which said compound contained by said solution is at least one selected from the group consisting of aluminum nitrate, aluminum sulfate and aluminum chloride.

8. The method of claim 1, in which said compound contained by said solution is at least one selected from the group consisting of alkyl compound of aluminum, alkoxy compound of aluminum, alkyl halide compound of aluminum, alkoxy halide compound of aluminum, aromatic compound of aluminum, aromatic halide compound of aluminum and chelate compound of aluminum.

9. The method of claim 1, in which said compound contained by said solution is at least one selected from the group consisting of ALCH-TR, $CH_3AlCl_2$, $(CH_3)_3AL$, $(C_2H_5)_3Al$, $(C_6H_5)_3Al$, $Al(C_2H_5)_3\cdot(C_2H_5)_2O$, $(P\text{-}CH_3C_6H_4)_3Al$ and $(CH_3)_2AlOCH_3$.

10. The method of claim 1, in which said compound contained by said solution is at least one selected from the group consisting of organometallic compound of titanium and inorganic compound of titanium.

11. The method of claim 1, in which said compound contained by said solution is at least one selected from the group consisting of titanium nitrate, titanium sulfate and titanium chloride.

12. The method of claim 1, in which said compound contained by said solution is at least one selected from the group consisting of alkyl compound of titanium, alkoxy compound of titanium, alkyl halide compound of titanium, alkoxy halide compound of titanium, aromatic compound of titanium, aromatic halide compound of titanium and chelate compound of titanium.

13. The method of claim 1, in which said compound contained by said solution is at least one selected from the group consisting of TBT, $(\pi\text{-}C_5H_5)_2Ti$, $(CH_3)Cl_3Ti$, $(\pi\text{-}C_5H_5)_2(C_6H_5)_2Ti$, $(i\text{-}C_3H_7O)_3(C_6H_5)Ti$ and $(CH_3)_2Cl_2Ti$.

14. The method of claim 1, in which said compound contained by said solution is dissolved in at least one solvent selected from the group consisting of water, aqueous alkaline solution and aqueous acidic solution, wherein the hydrogen exponent of said solvent ranges from 0 to 14.

15. The method of claim 1, in which said compound contained by said solution is dissolved in at least one solvent selected from the group consisting of benzen, derivative of benzene, aliphatic hydrocarbon and alicyclic hydrocarbon, wherein said solvent has a melting point of lower than room temperature and a boiling point of hygher than room temperature.

16. The method of claim 1, in which the content of said compound in said solution ranges from 0.1 g/l to 25 g/l.

17. The method of claim 1, in which the temperature of heating said powder ranges from 220° C. to 350° C.

18. The method of claim 2, in which said solution containing silver ions is a solution of inorganic silver salt whose content ranges from 0.05 g/l to 30 g/l.

19. The method of claim 18, in which said silver salt is one selected from the group consisting of silver nitrate, silver sulfate and silver chloride.

20. The method of claim 18, in which the content of said silver salt ranges from 0.1 g/l to 25 g/l.

21. The method of claim 19, in which the content of said silver salt ranges from 0.1 g/l to 25 g/l.

22. The method of claim 2, in which the temperature of heating said powder ranges from 220° C. to 350° C.

23. A method of producing ferromagnetic iron powder comprising the steps of:

(i) coating a needlelike-shaped starting raw material powder with a solution containing from 0.05 g/l to 100 g/l of as least one compound selected from the group consisting of aluminum compound and titanium compound, said raw material being at least one selected from the group consisting of oxalate, formate, oxide and oxyhydroxide of iron, (ii) heating said powder at temperature ranging from 220° C. to 450° C. in a reducing atmosphere, and (iii) cooling said powder reduced in the preceding step (ii).

24. The method of claim 23, in which a solution containing silver ions is used with the solution of said aluminum and/or titanium compound at step (i).

* * * * *